US011608239B2

(12) United States Patent
Taguchi

(10) Patent No.: US 11,608,239 B2
(45) Date of Patent: Mar. 21, 2023

(54) SHEET PROCESSING DEVICE

(71) Applicant: KYOCERA Document Solutions Inc., Osaka (JP)

(72) Inventor: Masanori Taguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/654,201

(22) Filed: Mar. 9, 2022

(65) Prior Publication Data

US 2022/0315366 A1 Oct. 6, 2022

(30) Foreign Application Priority Data

Mar. 31, 2021 (JP) ..... JP2021-059518

(51) Int. Cl.
*B65H 9/00* (2006.01)
*B65H 11/02* (2006.01)
*B41J 11/00* (2006.01)

(52) U.S. Cl.
CPC ..... *B65H 11/02* (2013.01); *B41J 11/0015* (2013.01); *B65H 2301/13* (2013.01); *B65H 2301/332* (2013.01)

(58) Field of Classification Search
CPC ..... B65H 31/20; B65H 9/002; B65H 37/04; B65H 37/06
USPC ..... 271/184, 185
See application file for complete search history.

(56) References Cited

U.S. PATENT DOCUMENTS 5,224,696 A * 7/1993 Kellum, III ..... B65H 9/166 271/251
5,915,689 A * 6/1999 Everdyke ..... B65H 9/103 271/236
5,931,462 A * 8/1999 Delfosse ..... B65H 9/002 271/228
6,042,105 A * 3/2000 Peulen ..... B65H 5/18 271/226
6,343,686 B1 * 2/2002 Whiting ..... B65H 29/16 198/379
8,061,709 B2 * 11/2011 Lewalski ..... B65H 5/062 271/274
8,132,810 B2 * 3/2012 Inui ..... B65H 9/16 271/251

(Continued)

FOREIGN PATENT DOCUMENTS

JP 2006127537 A 5/2006

*Primary Examiner* — Leslie A Nicholson, III
(74) *Attorney, Agent, or Firm* — Alleman Hall Creasman & Tuttle LLP

(57) ABSTRACT

A rotation device rotates a sheet on an upstream side of, in a sheet conveyance orientation, a working device positioned in a middle of a conveyance path, thereby changing an orientation of the sheet. An information acquiring portion acquires sheet size information and sheet orientation information representing a size and the orientation of the sheet in a sheet storing portion, and working position information representing a working position on the sheet. A rotation control portion controls the rotation device in accordance with the sheet orientation information and the working position information. The working control portion controls the working device in accordance with the orientation of the sheet after passing through the rotation device, and the sheet size information and the working position information.

4 Claims, 6 Drawing Sheets

(56) References Cited

U.S. PATENT DOCUMENTS

| | | | | |
|---|---|---|---|---|
| 8,447,223 | B2 * | 5/2013 | Inui | G03G 15/232<br>271/251 |
| 9,199,815 | B2 * | 12/2015 | Katsura | B65H 7/20 |
| 11,498,347 | B2 * | 11/2022 | Nakazawa | B41J 2/165 |

* cited by examiner

SHEET PROCESSING DEVICE

INCORPORATION BY REFERENCE

This application is based upon and claims the benefit of priority from the corresponding Japanese Patent Application No. 2021-059518 filed on Mar. 31, 2021, the entire contents of which are incorporated herein by reference.

BACKGROUND

This disclosure relates to a sheet processing device capable of processing a sheet.

A post-processing device may be connected to an image forming apparatus. The image forming apparatus forwards a sheet stored in a sheet storing portion to a conveyance path, and further conveys the sheet along the conveyance path while forming an image on the sheet. The post-processing device includes a working device that performs processes such as stapling or punching on the sheet on which the image is formed.

A device including the image forming apparatus and the post-processing device is an example of the sheet processing device capable of processing the sheet.

In addition, in the post-processing device, it has been known that a working position on the sheet can be selected from a plurality of positions.

SUMMARY

A sheet processing device according to one aspect of the present disclosure includes one or more sheet storing portions, a conveying device, a working device, a rotation device, an information acquiring portion, a rotation control portion, and a working control portion. The sheet storing portion can store a sheet. The conveying device forwards the sheet stored in the sheet storing portion to a conveyance path, and further conveys the sheet along the conveyance path. The working device processes the sheet in the middle of the conveyance path. The rotation device causes the sheet to be rotated along a surface of the sheet on an upstream side of, in a sheet conveyance orientation, the working device positioned in the middle of the conveyance path, so that an orientation of the sheet is changed. The information acquiring portion acquires sheet size information and sheet orientation information representing a size and an orientation of the sheet stored in the sheet storing portion, and working position information representing a working position on the sheet. The rotation control portion controls the rotation device in accordance with the sheet orientation information and the working position information. The working control portion controls the working device in accordance with the sheet orientation information and a later-stage sheet orientation, and the sheet size information and the working position information. The later-stage sheet orientation is an orientation of the sheet after passing through the rotation device, and is determined in accordance with a control result of the rotation device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Sheet Processing Device 10]

Figure 1:
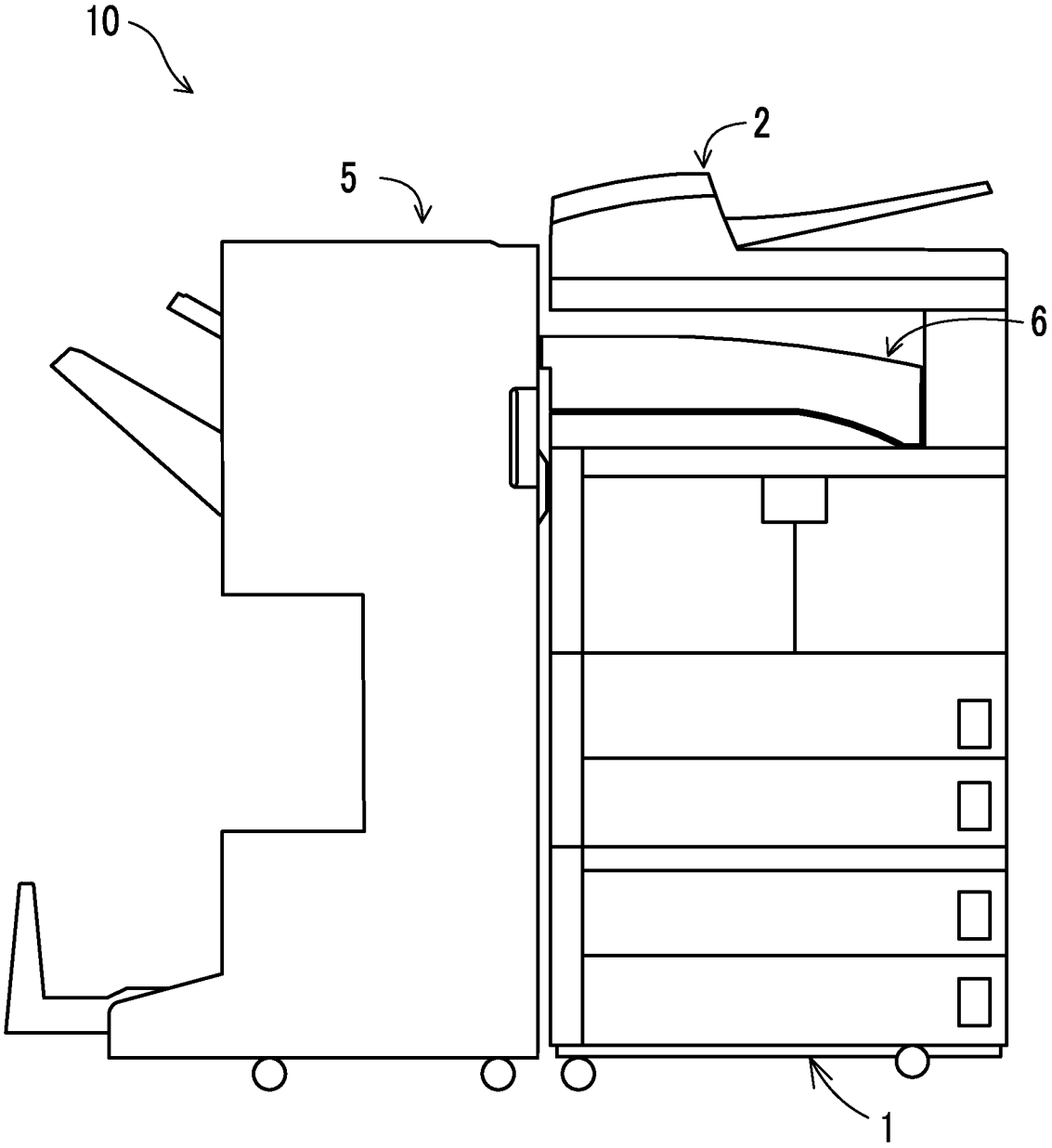
FIG. 1 is a front view of a sheet processing device according to an embodiment.

A sheet processing device 10 according to an embodiment includes an image forming apparatus 1, an image reading device 2, a relay unit 6, and a post-processing device 5 (see FIG. 1). In addition, the sheet processing device 10 includes a controller 8, an operating device 801, and a display 802 (see FIG. 2).

For example, the sheet processing device 10 may be, for example, a multifunction device that functions as a printer, a copier, a scanner, and a facsimile device.

The image forming apparatus 1 executes a print processing that forms an image on a sheet 9. The image reading device 2 executes an image reading processing that reads the image from an original document.

The image reading device 2 is connected to an upper part of the image forming apparatus 1. The relay unit 6 is mounted to the image forming apparatus 1 in a space between the image forming apparatus 1 and the mage reading device 2. In addition, the post-processing device 5 is connected to respective side surfaces of the image forming apparatus 1 and the relay unit 6.

The relay unit 6 relays conveyance of the sheet 9 between the image forming apparatus 1 and the post-processing device 5. The post-processing device 5 executes various processes on the sheet 9 conveyed via the relay unit 6.

Figure 2:
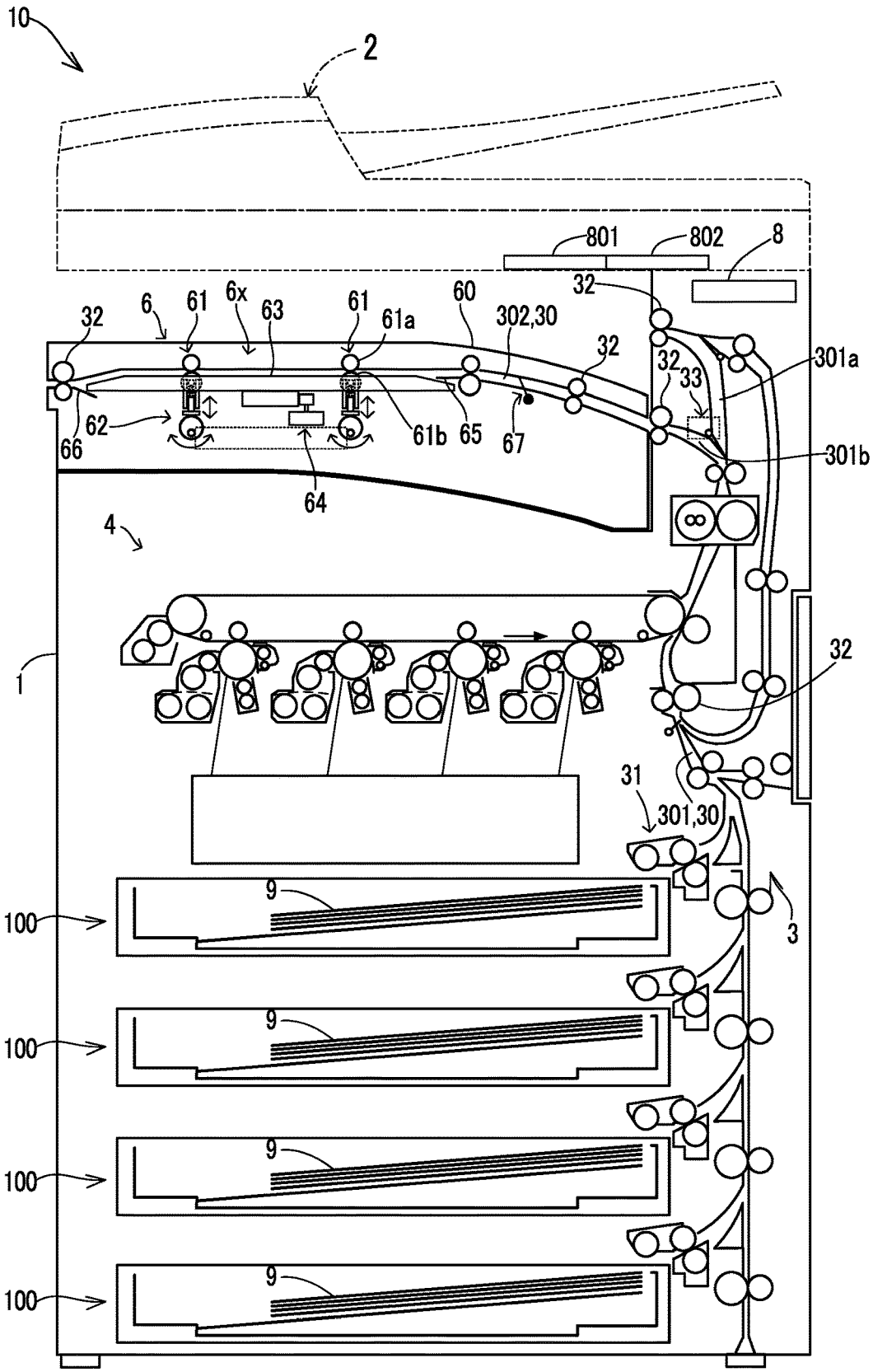
FIG. 2 is a configuration diagram of an image forming apparatus and a relay unit in the sheet processing device according to the embodiment.
Figure 3:
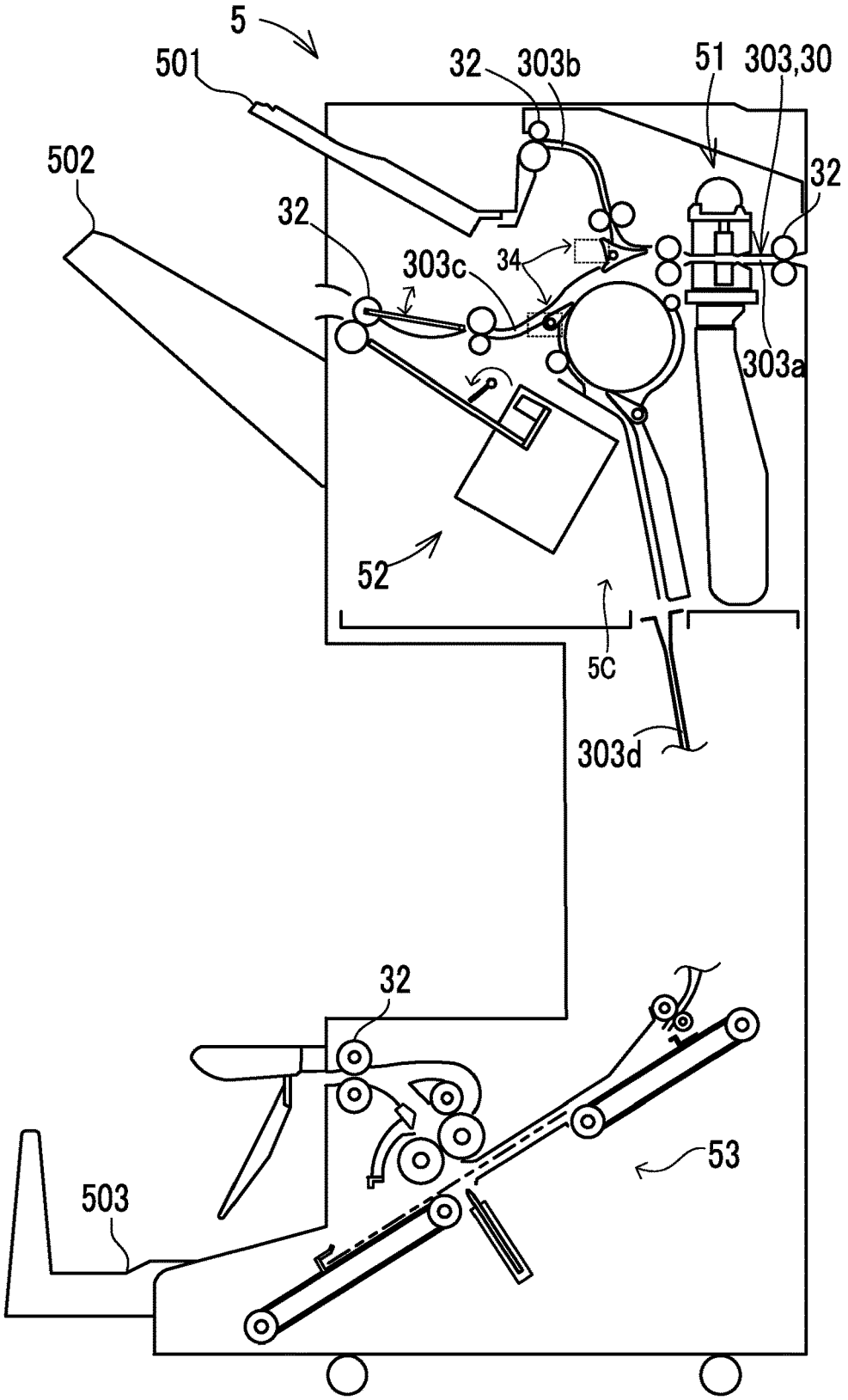
FIG. 3 is a configuration diagram of a post-processing device in the sheet processing device according to the embodiment.

The sheet processing device 10 has a conveyance path 30 provided through the image forming apparatus 1, the relay unit 6, and the post-processing device 5 (see FIGS. 2 and 3). The conveyance path 30 forms a passage through which the sheet 9 passes.

The conveyance path 30 has a main conveyance path 301 provided inside the image forming apparatus 1, a relay conveyance path 302 provided inside the relay unit 6, and a rear conveyance path 303 provided inside the post-processing device 5. The relay conveyance path 302 is connected to the main conveyance path 301 and the rear conveyance path 303.

In addition, the sheet processing device 10 includes a conveying device 3 provided through the image forming apparatus 1, the relay unit 6, and the post-processing device 5 (see FIGS. 2 and 3). The conveying device 3 forwards the sheet 9 stored in a sheet storing portion 100 to a conveyance path 30, and further conveys the sheet 9 along the conveyance path 30.

Specifically, the conveying device 3 includes a forwarding mechanism 31 that forwards the sheet 9 from the sheet storing portion 100 to the main conveyance path 301. In addition, the conveying device 3 has a plurality of pairs of conveyance rollers 32 conveying the sheet 9 along the main conveyance path 301, the relay conveyance path 302, and the rear conveyance path 303.

The plurality of pairs of the conveyance rollers 32 is driven in rotation by a motor (not illustrated), thereby conveying the sheet 9 along the conveyance path 30.

The main conveyance path 301 has two branched paths, a first branch path 301*a* and a second branch path 301*b* (see FIG. 2). The conveying device 3 further includes a first route switching mechanism 33 that selectively guides the sheet 9 to one of the first branch path 301*a* and the second branch path 301*b*. The second branch path 301*b* communicates with the relay conveyance path 302.

The operating device 801 is a device that accepts user's operations. For example, the operating device 801 has one of or both a push button and a touch panel. The display 802 also has a panel display unit that displays information.

[Image Forming Apparatus 1]

As illustrated in FIG. 2, the image forming apparatus 1 includes one or more sheet storing portions 100, a part of the conveying device 3, and a print device 4. The sheet storing portion 100 can store a plurality of sheets 9.

In an example of FIG. 2, the sheet processing device 10 has the sheet storing portions 100. The sheet 9 is an image forming medium such as a paper or a resin film.

The print device 4 executes a print processing that forms the image based on data to be printed, on the sheet 9 conveyed by the conveying device 3. The data to be printed is data including information of an output image.

In an example of FIG. 1, the print device 4 executes the print processing by an electrophotographic method. However, the print device 4 may be a device that executes the print processing by an inkjet method or other methods.

The conveying device 3 conveys the sheet 9 on which the image is formed by the print device 4, to the first branch path 301*a* or the second branch path 301*b*.

[Relay Unit 6]

The relay unit 6 is disposed between the image forming apparatus 1 and the post-processing device 5, and conveys the sheet 9 on which the image is formed, the sheet 9 to be conveyed from the second branch path 301*b* to the relay conveyance path 302 of the image forming apparatus 1, to the rear conveyance path 303 of the post-processing device 5.

The relay unit 6 has, on an upper surface thereof, an intermediate discharge tray 60 receiving the sheet 9 discharged from the first branch path 301*a*.

[Post-Processing Device 5]

The post-processing device 5 includes one or more working devices that process the sheet 9 in the middle of the rear conveyance path 303. The one or more working devices process the sheet 9 on which the image is formed.

In an example of FIG. 3, the one or more working devices each include a punching device 51, a staple device 52, and a sheet folding device 53. In addition, the post-processing device 5 has a first post-discharge tray 501, a second post-discharge tray 502, and a third post-discharge tray 503 which receive the sheet 9 onto which processing has been subjected.

The punching device 51 executes a punching processing to punch the sheet 9 so as to make a hole. The staple device 52 executes a staple processing to bind the plurality of sheets 9 together. The sheet folding device 53 executes a folding processing to fold the sheet 9 in half or in three.

The rear conveying path 303 provided inside the post-processing device 5 has a rear main path 303*a*, which communicates with the relay conveying path 302, a third branch path 303*b*, a fourth branch path 303*c*, and a fifth branch path 303*d*, which branch from the rear main path 303*a*, respectively.

In addition, the conveying device 3 further includes a second route switching mechanism 34 that selectively guides the sheet 9 that has passed through the rear main path 303*a* to one of the third branch path 303*b*, the fourth branch path 303*c*, and the fifth branch path 303*d*.

The punching device 51 executes the punching processing to punch the sheet 9 in the rear main path 303*a*. The sheet 9 subjected to the punching processing is conveyed to any one of the third branch path 303*b*, the fourth branch path 303*c*, and the fifth branch path 303*d*.

The conveying device 3 discharges the sheet 9 conveyed to the third branch path 303*b* onto the first post-discharge tray 501.

The staple device 52 executes the staple processing to staple the sheet 9 conveyed to the fourth branch path 303*c*. The conveying device 3 discharges the sheet 9 subjected to the staple processing onto the second post-discharge tray 502.

The sheet folding device 53 executes the folding processing to fold the sheet 9 conveyed to the fifth branch path 303*d*. The conveying device 3 discharges the sheet 9 subjected to the folding processing onto the third post-discharge tray 503.

[Controller 8]

The controller 8 executes various kinds of data processing and a control of the sheet processing device 10.

Figure 4:
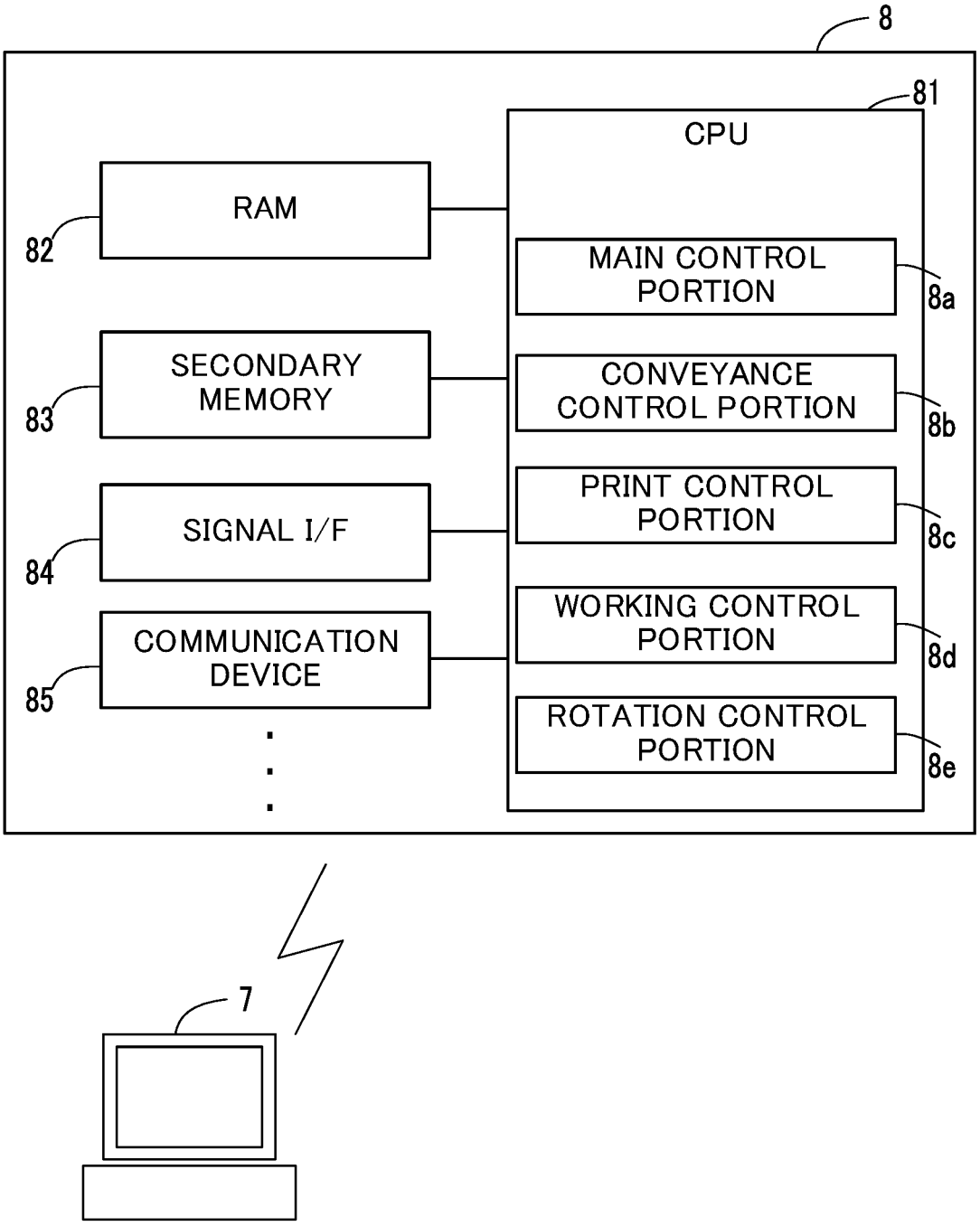
FIG. 4 is a block diagram of a configuration of a controller in the sheet processing device according to the embodiment.

As illustrated in FIG. 4, the controller 8 includes a Central Processing Unit (CPU) 81, a Random Access Memory (RAM) 82, and peripherals such as a secondary memory 83, and a signal interface 84. In addition, the controller 8 includes a communication device 85 capable of communicating with other devices such as a host device 7.

The secondary memory 83 is a computer readable non-volatile storage memory. The secondary memory 83 can store and update computer program and various kinds of data. For example, one of or both a flash memory or a hard disk drive is adopted as the secondary memory 83.

The signal interface 84 converts signals outputted by various sensors into digital data, and transmits such converted digital data to the CPU 81. Furthermore, the signal interface 84 converts control commands outputted by the CPU 81 into control signals. The control signals are transmitted to a device to be controlled.

The communication device 85 executes communication with other devices such as the host device 7 that transmits a job to the sheet processing device 10. The CPU 81 communicates with other devices through the communication device 85. The job includes information that specifies processing details processed by the print processing and the working device. The job includes the data to be printed.

The CPU 81 is a processor that executes the computer program and executes processing and control of various kinds of data. The RAM 82 is a computer-readable volatile memory. The RAM 82 temporarily stores the computer program executed by the CPU 81, and data to be output and referenced in a process of executing various processes by the CPU 81.

The CPU 81 has a plurality of processing modules realized by executing the computer program. The plurality of processing modules includes a main control portion 8*a*, a conveyance control portion 8*b*, a print control portion 8*c*, a working control portion 8*d*, and the like.

The main control portion 8*a* executes a control to start various processes in accordance with an operation for the operating device 801 and a control for the display 802.

The conveyance control portion 8*b* controls the conveying device 3, thereby controlling a feeding of the sheet 9 from the sheet storing portion 100 and a conveyance of the sheet 9 along the conveyance path 30. The print control portion 8*c* causes, in synchronization with the conveyance of the sheet 9 by the conveying device 3, the print device 4 to execute the print processing.

The working control portion 8*d* executes a working control that controls the working device. For example, the working control portion 8*d* controls one of or both the punching device 51 and the staple device 52 based on sheet size information, sheet orientation information and working position information, which are acquired in advance in the working control.

The sheet size information and the sheet orientation information represent a size and an orientation of the sheet 9 in the sheet storing portion 100, respectively. The working position information represents a working position on the sheet 9.

Execution of the working control allows one of or both the punching processing and the staple processing to be subjected to the sheet 9 at a position corresponding to the working position information.

In addition, the working control portion 8*d* controls the sheet folding device 53 based on the sheet size information, the sheet orientation information, and folding number information, which are acquired in advance in the working control, respectively.

The working position information represents a specified position selected from a plurality of predetermined candidate positions. That is, the punching device 51 can perform the punching processing at any one of the plurality of candidate positions on the sheet 9. Similarly, the staple device 52 can perform the staple processing at any one of the plurality of candidate positions on the sheet 9.

A position where the working device can be processed onto the sheet 9 is limited depending on an orientation of the sheet 9 in the sheet storing portion 100. It is troublesome to change the orientation of the sheet 9 in the sheet storing portion 100 in accordance with the working position on the sheet 9.

Figure 5:
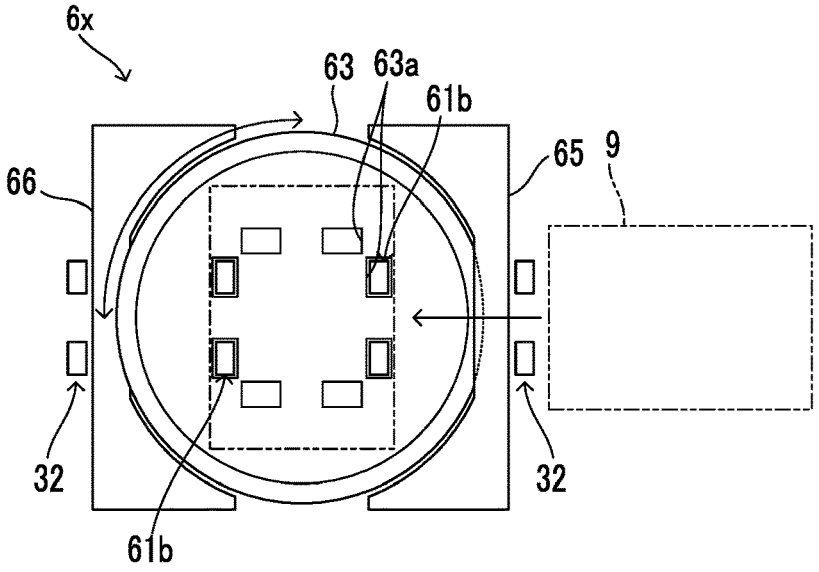
FIG. 5 is a configuration diagram of a rotation device in the sheet processing device according to the embodiment.

As illustrated in FIG. 2 and FIG. 5, the sheet processing device 10 includes a rotation device 6*x*. The rotation device 6*x* changes the orientation of the sheet 9 by rotation of the sheet 9 along a surface thereof. In the present embodiment, the rotation device 6*x* is provided inside the relay unit 6.

In addition, the plurality of processing modules in the CPU 81 further includes a rotation control portion 8*e* that controls the rotation device 6*x* (see FIG. 4).

The sheet processing device 10 includes the rotation device 6*x*, which reduces the trouble of changing the orientation of the sheet 9 in the sheet storing portion 100 in accordance with the working position on the sheet 9.

[Rotation Device 6*x*]

The rotation device 6*x* causes the sheet 9 to be rotated on an upstream side of, in a sheet conveyance orientation, the working device positioned in the middle of the conveyance path 30. In the present embodiment, the rotation device 6*x* causes the sheet 9 to be rotated in the relay conveyance path 302.

As illustrated in FIG. 2 and FIG. 5, the rotation device 6*x* has two pairs of resist rollers 61, a roller movement mechanism 62, a turntable 63, a table drive mechanism 64, a front sheet guide 65, a rear sheet guide 66, and a sheet detection portion 67.

Each pair of the resist rollers 61 has a drive roller 61*a* rotationally driven by a motor (not illustrated), and a driven roller 61*b* coming in contact with a lower surface of the drive roller 61*a*. The driven roller 61*b* is driven in rotation with respect to the drive roller 61*a*.

Each pair of the resist rollers 61 is rotated while sandwiching the sheet 9, thereby conveying the sheet 9 along the relay conveyance path 302.

The front sheet guide 65 guides the sheet 9 conveyed along the relay conveyance path 302, to each pair of the resist rollers 61.

The roller movement mechanism 62 is a mechanism to move the driven roller 61*b* in the two pairs of the resist rollers 61, between an actuation position and a retract position. For example, the roller movement mechanism 62 includes a cam mechanism and a motor that drives the cam mechanism.

The driven roller 61*b* comes in contact with the lower surface of the drive roller 61*a* at the actuation position. On the other hand, the driven roller 61*b* is separated downward from the drive roller 61*a* at the retract position.

The turntable 63 is located along the relay conveyance path 302 and is rotatably supported. The turntable 63 has a plurality of openings 63*a* exposing two driven rollers 61*b* to the relay conveyance path 302 (see FIG. 5).

The two driven rollers 61*b* come in contact with two drive rollers 61*a* through the openings 63*a* of the turntable 63. That is, the two driven rollers 61*b* protrude from the openings 63*a* of the turntable 63 to the relay conveyance path 302 when the two driven rollers 61*b* are in the actuation position.

On the other hand, the two driven rollers 61*b* are located below the turntable 63 when the two driven rollers 61*b* in the retract position. Therefore, when the two driven rollers 61*b* are in the retract position, the turntable 63 can be rotated without interfering with the two driven rollers 61*b*.

When the two pairs of the resist rollers 61 are stopped while sandwiching the sheet 9, the sheet 9 is held above the turntable 63 by the two pairs of the resist rollers 61.

The sheet detection portion 67 detects the sheet 9 conveyed toward the two pairs of the resist rollers 61. For example, the sheet detection portion 67 has a displacement member and a detection sensor (not illustrated).

The displacement member comes in contact with the sheet 9 conveyed toward the two pairs of the resist rollers 61, thereby being displaced from a first position to a second position. The detection sensor detects the displacement member displaced to the second position.

The distance from the position of the sheet detection portion 67 to the center of rotation of the turntable 63, and a conveyance speed of the sheet 9 by the conveying device 3 are known. Therefore, the rotation control portion 8*e* checks a time period during which the sheet detection portion 67 continues to detect the sheet 9, thereby specifying the length of the sheet 9 in its conveyance direction.

Furthermore, the rotation control portion 8*e* stops the two pairs of the resist rollers 61 when a target time depending on the length of the sheet 9 in its conveyance direction has elapsed from a time of changing from a detecting state of the sheet 9 by the sheet detection portion 67 to an undetected state. Accordingly, the rotation control portion 8*e* can stop the conveyance of the sheet 9 at a center matching timing at which the center of the sheet 9 matches the center of rotation of the turntable 63.

The roller movement mechanism 62 can move the two driven rollers 61*b* from the actuation position to the retract position when the two pairs of the resist rollers 61 stop while sandwiching the sheet 9. After the two driven rollers 61*b* move from the actuation position to the retract position, the sheet 9 is placed on the turntable 63.

The table drive mechanism 64 allows the turntable 63 to be rotated by 90 degrees along a horizontal surface when the two driven rollers 61*b* exists at the retract position. This causes the sheet 9 to be rotated by 90 degrees along the surface of the sheet 9 while being placed on the turntable 63. As a result, the orientation of the sheet 9 on the turntable 63 changes in a state in which the center of the sheet 9 matches the center of rotation of the turntable 63.

After the table drive mechanism 64 rotates the turntable 63 by 90 degrees, the roller movement mechanism 62 allows the two driven rollers 61*b* to be moved from the retract position to the actuation position. Accordingly, the sheet 9 in which its orientation is changed is held above the turntable 63 by the two pairs of the resist rollers 61.

The two pairs of the resist rollers 61 are rotated again, thereby conveying the sheet 9 in which its orientation has been changed toward the rear conveyance path 303. The rear sheet guide 66 guides the sheet 9 conveyed by the two pairs of the resist rollers 61 to the rear conveyance path 303.

In the following description, a control in which the rotation control portion 8*e* causes the rotation device 6*x* to change the orientation of the sheet 9 is referred to as a sheet rotation control. Steps of the sheet rotation control will be described below.

The rotation control portion 8*e* stops rotation of the two pairs of the resist rollers 61 at the center matching timing. Subsequently, the rotation control portion 8*e* controls the roller movement mechanism 62, thereby moving the two driven rollers 61*b* from the actuation position to the retract position. In addition, the rotation control portion 8*e* controls the table drive mechanism 64, thereby causing the turntable 63 to be rotated by 90 degrees.

Next, the rotation control portion 8*e* controls the roller movement mechanism 62, thereby moving the two driven rollers 61*b* from the retract position to the actuation position. Finally, the rotation control portion 8*e* restarts rotation of the two pairs of the resist rollers 61.

The main control portion 8*a* restarts a job preparation process which will be described later when pre-inquiry information is received from the host device 7. The host device 7 transmits the pre-inquiry information to the sheet processing device 10 before transmission of the job to the sheet processing device 10.

Furthermore, when the main control portion 8*a* receives the job from the host device 7, the conveyance control portion 8*b* causes the conveying device 3 to convey the sheet 9 corresponding to the job, and the print control portion 8*c* causes the print device 4 to execute the print processing corresponding to the job. In addition, when the job contains information instructing a processing with respect to the sheet 9, the working control portion 8*d* and the rotation control portion 8*e* execute a post-processing control which will be described later (see FIG. 6 and FIG. 7).

[Job Preparation Process]

Hereinafter, an example of steps of the job preparation process will be described with reference to the flowchart illustrated in FIG. 6. In the following description, signs S101, S102, . . . represent reference numerals of a plurality of steps in the job preparation process. In the job preparation process, firstly, a process of Step S101 is executed.

<Step S101>

In Step S101, the main control portion 8*a* acquires target information included in the pre-inquiry information from the host device 7, and shifts a process to Step S102. The target information is information of a size of the sheet 9 for the print processing.

<Step S102>

In Step S102, the main control portion 8*a* acquires sheet information including the sheet size information and the sheet orientation information.

In the present embodiment, the main control portion 8*a* sets the sheet information for each sheet storing portion 100 in accordance with an operation with respect to the operating device 801, and can execute a process of recording the set sheet information in the secondary memory 83. In this case, in Step S102, the main control portion 8*a* acquires the sheet information from the secondary memory 83.

The sheet processing device 10 may have a size detection sensor that detects the size of the sheet 9 in a conveyance direction and a width direction for each sheet storing portion 100. The width direction corresponds to a direction that intersects the conveyance direction.

The main control portion 8*a* can identify the orientation of the sheet 9 in the sheet storing portion 100 by comparing sizes of the sheet 9 in the conveyance direction and the width direction detected by the size detection sensor. The size information in the conveyance direction and the width direction detected by the size detection sensor includes the sheet size information and the sheet orientation information.

Therefore, when the sheet processing device 10 includes the size detection sensor, the main control portion 8*a* can acquire, in Step S102, the sheet information from the size detection sensor.

<Step S103>

In Step S103, the main control portion 8*a* sets position candidate information representing working position candidates for the sheet 9. At this time, the main control portion 8*a* sets first candidate information and second candidate information so as to be distinguished in accordance with the sheet size information and the sheet orientation information.

The first candidate information is a candidate for the working position information to be set when the sheet 9 is not rotated by the rotation device 6*x*. The second candidate information is a candidate for the working position information to be set when the sheet 9 is rotated by the rotation device 6*x*.

The main control portion 8*a* sets the first candidate information and the second candidate information, and then shifts the process to Step S104.

<Step S104>

In Step S104, the main control portion 8*a* transmits the position candidate information that is set in Step S103 to the host device 7, and terminates the job preparation process.

That is, in Step S104, the main control portion 8*a* transmits the first candidate information and the second candidate information so as to be distinguished in accordance with the sheet size information and the sheet orientation information, to the host device 7.

The host device 7 is an example of an information output device capable of outputting information to a display unit, and the like. In addition, transmission of the first candidate information and the second candidate information to the host device 7 is an example of outputting the information to the information output device.

When the sheet 9 is rotated by the rotation device 6*x*, it takes a longer time for the sheet 9 to be conveyed to the working device than a case of unrotation of the sheet 9.

In the host device 7, the first candidate information and the second candidate information are distinguished and provided to the user as a candidate for the working position information. Such information provision may be information for determination by the user to set the working position information.

For example, the user can determine that the working position information is selected from the second candidate information when the number of sheets 9 to be processed is small. On the other hand, when the number of sheets 9 to be processed is large, the user can determine that the working position information is selected from the first candidate information after the orientation of the sheet 9 in the sheet storing portion 100 is changed.

The host device 7 selects the working position information from the first candidate information and the second candidate information in accordance with a selection operation for an operation portion such as a keyboard included in the host device 7. In addition, the host device 7 transmits the job including the selected working position information to the sheet processing device 10.

[Post-Processing Control]

Figure 7:
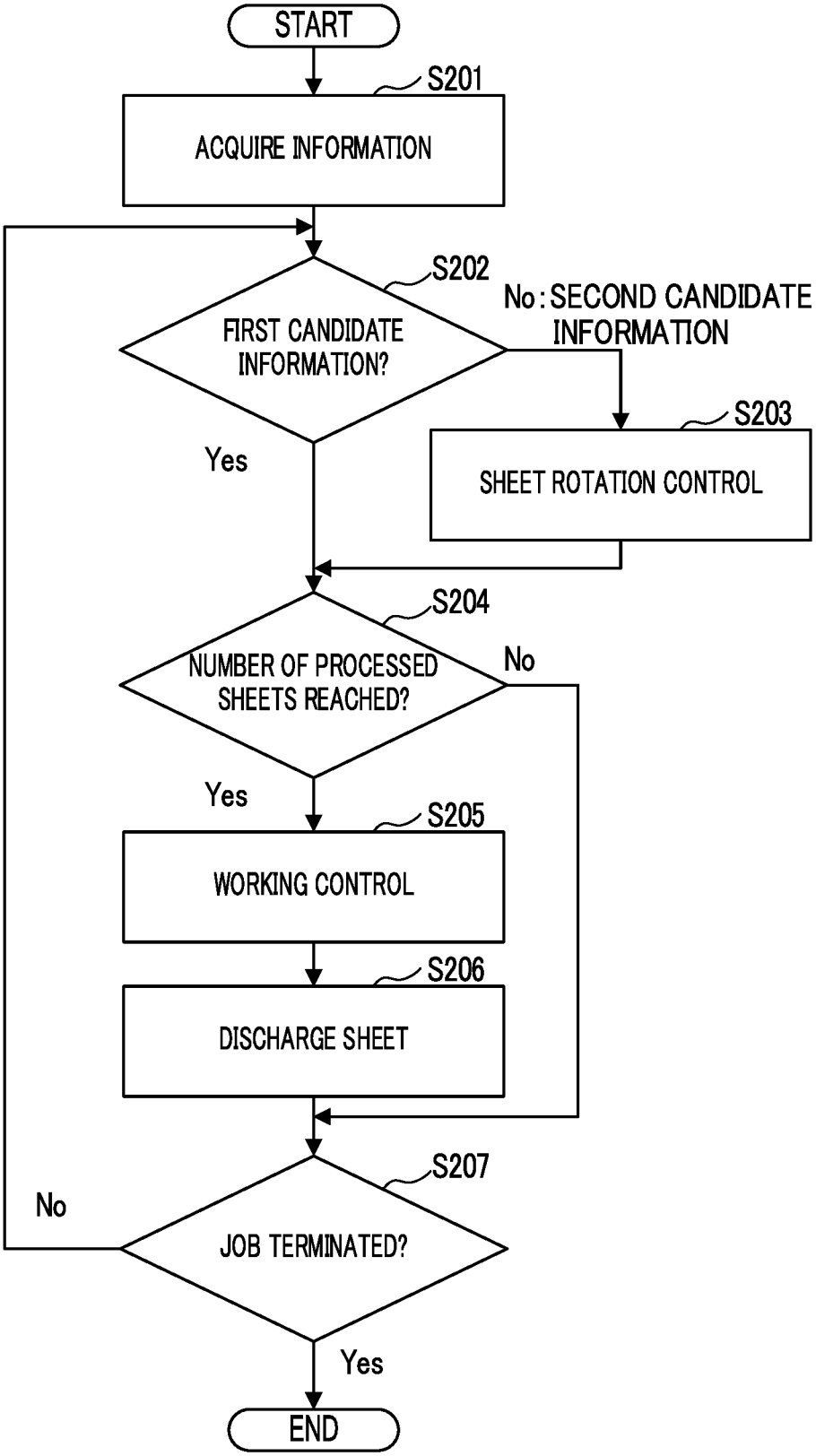
FIG. 7 is a flowchart illustrating an example of steps of the a post-processing control in the sheet processing device according to the embodiment.

Next, an example of steps of the post-processing control will be described with reference to the flowchart illustrated in FIG. 7. In the following description, signs S201, S202, . . . represent the reference numerals of a plurality of steps in the post-processing control. In the job preparation process, firstly, a process of Step S201 is executed.

<Step S201>

In Step S201, the main control portion 8*a* acquires the working position information and the sheet information included in the job received from the host device 7, and shifts a process to Step S202.

In Step S201, the main control portion 8*a* acquires the sheet information including the sheet size information and the sheet orientation information, in the same manner as Step S102.

In addition, in Step S201, the working position information acquired from the host device 7 is information selected from the first candidate information and the second candidate information. The host device 7 is an example of an information input device including a keyboard, and the like.

<Step S202>

In Step S202, the rotation control portion 8*e* determines whether the working position information is selected from the first candidate information or the second candidate information.

Specifically, the rotation control portion 8*e* identifies the first candidate information and the second candidate information in accordance with the sheet size information and the sheet orientation information, in the same manner as Step S103. In addition, the rotation control portion 8*e* determines whether the working position information is selected from which one of the first candidate information and the second candidate information.

The rotation control portion 8*e* shifts the process to Step S204 when determining that the working position information is selected from the first candidate information. The rotation control portion 8*e* shifts the process to Step S203 when the working position information is not selected from the first candidate information.

<Step S203>

In Step S203, the rotation control portion 8*e* executes the sheet rotation control at a timing when the sheet 9 conveyed via the print device 4 reaches the rotation device 6*x*. Accordingly, the rotation device 6*x* changes the orientation of the sheet 9, and then conveys the sheet 9 to the rear conveyance path 303.

The rotation control portion 8*e* executes the sheet rotation control, and shifts the process to Step S204.

When it is determined that the working position information is selected from the first candidate information, the process in Step S203 is skipped, and the rotation device 6*x* conveys the sheet 9 to the rear conveyance path 303 without rotating the sheet 9.

<Step S204>

In Step S204, the working control portion 8*d* determines whether the number of sheets 9 conveyed to the post-processing device 5 has reached the number of processed sheets represented by the information included in the job.

In the present embodiment, the punching device 51 always executes the punching processing with respect to one sheet 9. Therefore, the number of processed sheets corresponding to the punching processing is one.

On the other hand, the number of processed sheets corresponding to the staple processing or the folding processing is set within predetermined allowable number of sheets in the host device 7.

The working control portion 8*d* shifts the process to Step S205 when determining that the number of sheets 9 conveyed to the post-processing device 5 has reached the number of processed sheets. The working control portion 8*d* shifts the process to Step S207 when the number of sheets 9 conveyed to the post-processing device 5 has not reached the number of processed sheets.

<Step S205>

In Step S205, the working control portion 8*d* executes a working control that causes the working device to execute a working process with respect to the sheet 9.

In the following description, the sheet orientation information and the sheet size information corresponding to the sheet storing portion 100 as a sender of the sheet 9 are referred to as target orientation information and target size information, respectively.

When the job includes information indicating one of or both the punching processing and the staple processing with respect to the sheet 9, the working control portion 8*d* controls one of or both the punching device 51 and the staple device 52. At this time, the control portion 8*d* specifies a later-stage sheet orientation. The later-stage sheet orientation is an orientation of the sheet 9 after passing through the rotation device 6*x*. The later-stage sheet orientation is determined in accordance with the target orientation information and a control result of the rotation device 6*x*.

In addition, the working control portion 8*d* controls one of or both the punching device 51 and the staple device 52 in accordance with the specified later-stage sheet orientation, and the target size information and the working position information. Accordingly, one of or both the punching processing and the staple processing is subjected to a part of the sheet 9 corresponding to the working position information.

On the other hand, when the job includes information instructing the folding processing with respect to the sheet 9, the working control portion 8*d* controls the sheet folding device 53 based on the sheet size information, the sheet orientation information, and the folding number information.

The working control portion 8*d* executes the working control, and shifts the process to Step S206.

<Step S206>

In Step S206, the conveyance control portion 8*b* causes the conveying device 3 to execute a process of discharging the sheet 9 that has been processed to any one of the three discharge trays 501 to 503. After that, the conveyance control portion 8*b* shifts the process to Step S207.

<Step S207>

In Step S207, the working control portion 8*d* determines whether the job is terminated. The working control portion 8*d* terminates the post-processing control when determining that the job is terminated. The working control portion 8*d* shifts the process to Step S202 when determining that the job is not terminated.

As described above, the main control portion 8*a* acquires the sheet size information, the sheet orientation information, and the working position information (Step S201). The main control portion 8*a* that executes the process of Step S201 is an example of an information acquiring portion.

In addition, the rotation control portion 8*e* controls the rotation device 6*x* in accordance with the sheet orientation information and the working position information (Step S203).

In addition, the working control portion 8*d* controls the working device in accordance with the sheet orientation information and the later-stage sheet orientation, and the sheet size information and the working position information (Step S205). As described above, the later-stage sheet orientation is the orientation of the sheet 9 after passing through the rotation device 6*x*.

According to the present embodiment, a trouble of changing the orientation of the sheet 9 in the sheet storing portion 100 in accordance with the working position on the sheet 9 is reduced. p [Applicable Example]

An applicable example of the sheet processing device 10 will be described as follows.

Figure 6:
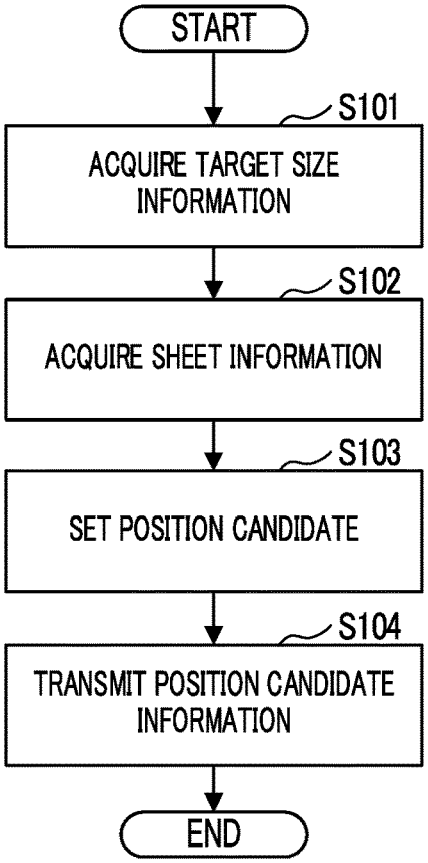
FIG. 6 is a flowchart illustrating an example of steps of a job preparation process in the sheet processing device according to the embodiment.

The main control portion 8*a* of this applicable example further acquires sheet numbers information representing the number of sheets 9 to be processed, in Step S101 of FIG. 6.

In addition, the main control portion 8*a* calculates first processing time information corresponding to the first candidate information and second processing time information corresponding to the second candidate information, in Step S103 of FIG. 6.

The first processing time information represents a time required for processing the number of sheets 9 corresponding to the sheet numbers information in a first case. The first case is a case in which the working position information is selected from the second candidate information.

On the other hand, the second processing time information represents a time required for processing the number of sheets 9 corresponding to the sheet numbers information in a second case. The second case is a case when the orientation of the sheet 9 in the sheet storing portion 100 is changed and then the working position information representing a position corresponding to the second candidate information is selected.

The main control portion 8*a* transmits the first processing time information and the second processing time information, in association with second candidate information, to the host device 7, in Step S104 of FIG. 6.

The first processing time information and the second processing time information may be information for determination by the user to set the working position information.

For example, the user compares the first processing time information and the second processing time information. When a time difference therebetween is relatively small, the user can determine that the working position information is selected from the second candidate information. On the other hand, when such time difference is large, the user can also determine that the working position information is selected from the first candidate information after changing the orientation of the sheet 9 in the sheet storing portion 100.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet processing device comprising:

one or more sheet storing portions capable of storing a sheet;

a conveying device that forwards the sheet stored in the sheet storing portion to a conveyance path and conveys the sheet along the conveyance path;

a working device that processes the sheet in a middle of the conveyance path;

a rotation device that causes the sheet to be rotated along a surface of the sheet on an upstream side of, in a sheet conveyance orientation, the working device positioned in the middle of the conveyance path, so that an orientation of the sheet is changed;

an information acquiring portion that acquires sheet size information and sheet orientation information representing a size and an orientation of the sheet stored in the sheet storing portion, and working position information representing a working position on the sheet;

a rotation control portion that controls the rotation device in accordance with the sheet orientation information and the working position information; and a working control portion that controls the working device in accordance with the sheet orientation information and a later-stage sheet orientation, and the sheet size information and the working position information, wherein later-stage sheet orientation is an orientation of the sheet after passing through the rotation device and is determined in accordance with a control result of the rotation device.

2. The sheet processing device according to claim 1, wherein the information acquiring portion outputs first candidate information and second candidate information distinguished in accordance with the sheet size information and the sheet orientation information to an information output device, the first candidate information as a candidate for the working position information to be set when the sheet is not rotated, the second candidate information as a candidate for the working position information to be set when the sheet is rotated, and the information acquiring portion acquires the working position information selected from the first candidate information and the second candidate information, from an information input device.

3. The sheet processing device according to claim 2, wherein the information acquiring portion further acquires sheet numbers information representing the number of sheets to be processed, and outputs first processing time information and second processing time information, in association with the second candidate information, to the information output device, the first processing time information representing a time required for processing the number of sheets corresponding to the sheet numbers information when the working position information is selected from the second candidate information, the second processing time information representing a time required for processing the number of sheets corresponding to the sheet numbers information when changing the orientation of the sheet in the sheet storing portion and selecting the working position information representing a position corresponding to the second candidate information.

4. The sheet processing device according to claim 1, further comprising a print device that forms an image on the sheet conveyed by the conveying device, wherein the working device processes the sheet on which the image is formed.

* * * * *